US008319583B2

(12) United States Patent
Huettner

(10) Patent No.: US 8,319,583 B2
(45) Date of Patent: Nov. 27, 2012

(54) MULTI-LAYER RADIAL POWER DIVIDER/COMBINER

(75) Inventor: Steven E. Huettner, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 572 days.

(21) Appl. No.: 12/545,980

(22) Filed: Aug. 24, 2009

(65) Prior Publication Data

US 2011/0043301 A1 Feb. 24, 2011

(51) Int. Cl.
*H01P 5/12* (2006.01)

(52) U.S. Cl. ..... 333/136; 333/100; 333/125; 333/128; 333/134

(58) Field of Classification Search ..... 333/100, 333/124–130, 132, 134–137
See application file for complete search history.

(56) References Cited

U.S. PATENT DOCUMENTS

| | | | | |
|---|---|---|---|---|
| 4,234,854 | A | 11/1980 | Schellenberg | |
| 4,556,856 | A * | 12/1985 | Presser | 333/124 |
| 4,641,106 | A | 2/1987 | Belohoubek | |
| 5,021,755 | A * | 6/1991 | Gustafson | 333/128 |
| 5,283,540 | A * | 2/1994 | Myer | 333/127 |
| 7,113,056 | B2 | 9/2006 | Wu | |
| 7,164,903 | B1 * | 1/2007 | Cliff et al. | 455/327 |

OTHER PUBLICATIONS

Stephen Horst et al. "Modified Wilkinson Power Dividers for Millimeter-Wave Integrated Circuits" IEEE Trans. on Microwave Theory and Techniques, vol. 55, No. 11, Nov. 2007 pp. 2439-2446.
P. Khan and L. Epp "Ka-Band Wide-Bandgap Solid-State Power Amplifier: Prototype Combiner Spurious Mode Suppression and POwer Constraints" IPN Progress Report 42-164 Feb. 15, 2006, pp. 1-18.
S0202AF High Frequency Thin Film Chip Resistor, State of the Art, Inc. Feb. 3, 2005.

* cited by examiner

*Primary Examiner* — Robert Pascal
*Assistant Examiner* — Kimberly Glenn
(74) *Attorney, Agent, or Firm* — Eric A. Gifford

(57) ABSTRACT

An N-way multi-layer radial power combiner/divider comprises an RF layer including N planar RF transmission lines radiating from a common port to N ports. An isolation layer substantially parallel to the RF layer comprises a star resistor having N resistive arms radiating from a common junction and N planar isolation transmission lines coupled in series to respective resistive arms. Each series pair of a resistive arm and an isolation transmission line is ideally a half-wavelength in electrical length. N vertical interconnects between the RF layer and the isolation layer connect the ends of the N isolation transmission lines to the ends of the N RF transmission lines at the N individual ports, respectively. Any path from one individual port through the common junction of the star resistor to another individual port is approximately a full wavelength λc or multiple thereof so that the phase angle through the isolation network is approximately zero degrees. This approach can achieve better isolation and power handling than the Wilkinson design while employing the benefits of planar metallization technology.

21 Claims, 12 Drawing Sheets

MULTI-LAYER RADIAL POWER DIVIDER/COMBINER

BACKGROUND OF THE INVENTION

1. Field of the Invention

This invention relates to radial power divider/combiners for use in solid-state power amplifiers (SSPAs), and more particularly to a multi-layer topology that realizes the cost benefits of planar fabrication without compromising the isolation characteristics of a Wilkinson divider/combiner for N-way devices where N is greater than two.

2. Description of the Related Art

Solid state power amplifier (SSPAs) modules are comprised of N identical amplifier devices that are combined into a single amplifier structure using a passive divider/combiner. SSPAs have a variety of uses. For examples, SSPAs may be used in satellites to provide transmit power levels sufficient for reception at ground-based receivers, or to perform the necessary amplification for signals transmitted to other satellites in a crosslink application. SSPAs are also suitable for ground-based RF applications requiring high output power such as cellular base stations. SSPAs are typically used for amplification from L-band to Ka-band (with future applications at even higher frequencies) spanning wavelength range of approximately 30 to 0.1 cm (approximately 1 GHz to 300 GHz).

Typical millimeter wave SSPAs achieve signal output levels of more than 10 watts. A single amplifier chip cannot achieve this level of power without incurring excessive size and power consumption (low efficiency). As shown in FIG. 1, an SSPA 10 uses a splitting and combining architecture in which the signal is divided into a number of individual parts and individually amplified. A 1:N power divider 12 splits input signal 14 into individual signals 16. Each signal is amplified by a respective amplifier chip 18 such as a GaAs pHEMT or GaN HEMT technology device. The output signals 20 of the amplifiers are then combined coherently via an N:1 power combiner 22 into a single amplified output signal 24 that achieves the desired overall signal power level. To maintain amplifier performance it is important that the paths through the power combiner are low loss, well isolated and have minimum phase errors.

Wilkinson developed the first isolated power divider/combiner 30 in 1959 as shown in FIGS. 2*a* and 2*b*. Wilkinson's N-way divider uses quarter-wave sections 32 of transmission lines for each arm that are isolated from each other by a star resistor network 34. The star resistor includes N resistors 36 connected at a common junction 38 (not ground). Each resistor 36 is connected to one of the quarter-wave sections 32 at a port 40 to external loads 42. These "loads" are comprised of the inputs or outputs of the amplifiers in an SSPA, depending on whether the splitter is used as a combiner or divider. The other ends of the quarter-wave sections 34 are joined at a common port 44 to an external load 46. In the case of a divider, this "load" would be the signal generator. Another quarter-wave section or cascade of sections (not shown) may be coupled to the common port to extend the bandwidth. Because sections 32 are 'quarter-wave' they function as an impedance matching transformer. Consequently the impedance seen looking into any of the individual ports 40 or common port 44 is Z0, the desired system impedance (typically 50 ohms). Impedance matching is important and common practice to eliminate mismatches that could cause gain ripples or reduced power in an SSPA combiner due to load-pull effects.

An N-way power divider/combiner works as follows. As a power divider, a signal enters the common port 1 and splits into equal-amplitude, equal-phase output signals at ports 2, 3, . . . N+1. Because each end of the isolation resistor 36 between any two ports 40 is at the same potential, no current flows through the resistor and therefore the resistor is decoupled from the input and dissipates none of the split signal power. As a power combiner, one must consider that equal amplitude/phase signals enter ports 2 through N+1 simultaneously. Again, each end of any isolation resistor is at the same potential and dissipates none of the combined signal power. To understand the port isolation that the resistor network provides, consider the case where a single signal is made to enter one of ports 2 through N+1. A fraction of its power (ideally, 1/N) will appear at Port 1, and the remainder of the signal is fully dissipated in the resistor network (if perfect isolation is provided), with none of the signal appearing at the other ports.

The N-way Wilkinson power divider can provide (ideally) perfect isolation at the center frequency, and adequate isolation (20 dB or more but this figure of merit is arbitrary and depends on design circumstances) over a substantial fractional bandwidth: isolation bandwidth can be increased by cascading multiple quarter-wavelength sections and adding additional isolation networks (star resistors for N>2).

In theory, Wilkinson's design can provide near perfect isolation and wide bandwidth. However, perfect isolation is never attained because electrically ideal resistors are not possible. These resistors are preferably as short as possible to minimize the phase angle that separates any two paths. However, even the smallest resistor induces a finite phase that limits isolation of the N ports and corrupts port impedance matching. Two resistors coupled in series each having an electrical length of $\lambda c/20$ produces a path length of $\lambda c/10$, which corresponds to a transmission phase angle of +36 degrees. To dissipate power caused by slightly mismatched amplifiers in an SSPA or a failure of one of its amplifiers the isolation resistor of the combiner network must be large enough to dissipate the worst-case heat load, which in turn induces a larger transmission phase. Maintaining symmetry of the isolation network and a near zero transmission phase angle is important to avoid degradation of RF performance.

Although two-way power divider/combiners are manufactured using planar technology, a significant limitation of a Wilkinson power divider/combiner is that it cannot be designed to take advantage of the lower production costs and other benefits of planar metallization technology for N greater than two. As shown in FIG. 2*a*, the star resistor 34 is placed at the end of cylinder and the quarter-wave sections 32 are placed longitudinally along the cylinder. This configuration preserves the isolation network but is expensive to manufacture and difficult to integrate into an SSPA. Planar metallization technology has not generally been applied to the N-way Wilkinson combiner because of topological problems that arise in physically locating the isolation resistors 36 so that they can be conveniently assembled but yet can properly dissipate incident power due to imbalances in the amplifiers or upon failure of the amplifier chips. Inadequate capacity or the isolating resistors to dissipate power causes unpredictable effects in the power output level of the composite amplifier upon failure of an elemental amplifier, or catastrophic failure of the entire SSPA.

For higher order, N>2, power divider/combiners the isolation network is either compromised for a planar layout as shown in FIGS. 3 and 4 or corporate strictures of 2:1 devices are employed as shown in FIG. 5. As shown in FIG. 3, a three-way Wilkinson power divider/combiner 50 is implemented in a planar topology by using a two-dimensional approximation of the Wilkinson device shown in FIGS. 2*a* and 2*b*. This is an N=3, two-section design where the RF passes through two quarterwave (90 degree) sections in cascade. In this case, one of the three isolation resistors is deleted from the layout and a "fork" arrangement is the result. The penalty that is paid for the compromised planar layout is reduced isolation and bandwidth. It is difficult to achieve 20 dB isolation between the opposite arms of this type of network over even a 10% bandwidth. As shown in FIG. 4, a 12-way planar radial combiner 60 provides isolation resistors 62 between adjacent paths. Isolation between the adjacent paths is high but isolation between non-adjacent paths is sacrificed. As shown in FIG. 5, an eight-way power divider/combiner 70 is implemented using a corporate structure of three stages of 2:1 divider/combiners 72 cascaded together. The penalty for this approach is increased RF losses, not just in the cascaded divider/combiner elements but in the interconnecting lines that are used to connect the stages. Additionally, the value of N is restricted to binary solutions such as N=2, N=4, N=8 and N=16. The unit cell 2:1 divider in this example is a three-section design where the RF passes through ¾ of a wavelength. The phase relationships between ports 2 through 9 are not maintained (the outside four paths are longer than the inside four paths), therefore it is not suitable for an SSPA. Some of the split signals must travel a path length of more than three wavelengths.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides an N-way radial power divider/combiner with a multi-layer planar topology without sacrificing the symmetry and phase properties of Wilkinson's isolation network.

In an embodiment, a radial power combiner/divider comprises an RF layer including N planar RF transmission lines radiating from a common port to N ports where N is an integer greater than two. The RF transmission lines are configured to transmit electromagnetic waves centered at a wavelength $\lambda c$. Each RF transmission line has an electrical length of approximately $A*\lambda c/4$ where A is an integer. An isolation layer substantially parallel to the RF layer comprises a star resistor having N resistive arms radiating from a common junction, each resistive arm having an electrical length L1 of no greater than $\lambda c/4$, and N planar isolation transmission lines of electrical length L2 coupled in series to respective resistive arms. Each series pair of a resistive arm and an isolation transmission line has an electrical length L1 plus L2 approximately equal $B*\lambda c/2$ where B is an integer and preferably 1 for best bandwidth. N vertical interconnects between the RF layer and the isolation layer connect the ends of the N isolation transmission lines to the ends of the N RF transmission lines at the N individual ports, respectively. Any path from one individual port through the common junction of the star resistor to another individual port is approximately a full wavelength $\lambda c$ or multiple thereof whereby the phase angle of the isolation network is approximately zero degrees at center frequency. For N>2 this approach can achieve better isolation than Wilkinson's design with while employing the benefits of planar metallization technologies.

These and other features and advantages of the invention will be apparent to those skilled in the art from the following detailed description of preferred embodiments, taken together with the accompanying drawings, in which:

DETAILED DESCRIPTION OF THE INVENTION

The present invention provides an N-way radial power divider/combiner with a multi-layer topology without sacrificing the symmetry and phase properties of Wilkinson's isolation network. In fact the proposed multi-layer topology can provide better phase properties than Wilkinson's thereby improving the isolation and higher power handling because it can use physically larger resistors. The radial power divider/combiner's isolation network is preferably configured so that separate paths are separated by an approximately zero phase angle at the center frequency to maximize path isolation. The multi-layer structure may be fabricated using low-cost planar metallization technologies. The divider/combiner may be used over a wavelength range of approximately 30 to 0.1 cm (approximately 1 GHz to 300 GHz) and higher frequencies as SSPA technology evolves.

Figure 6:
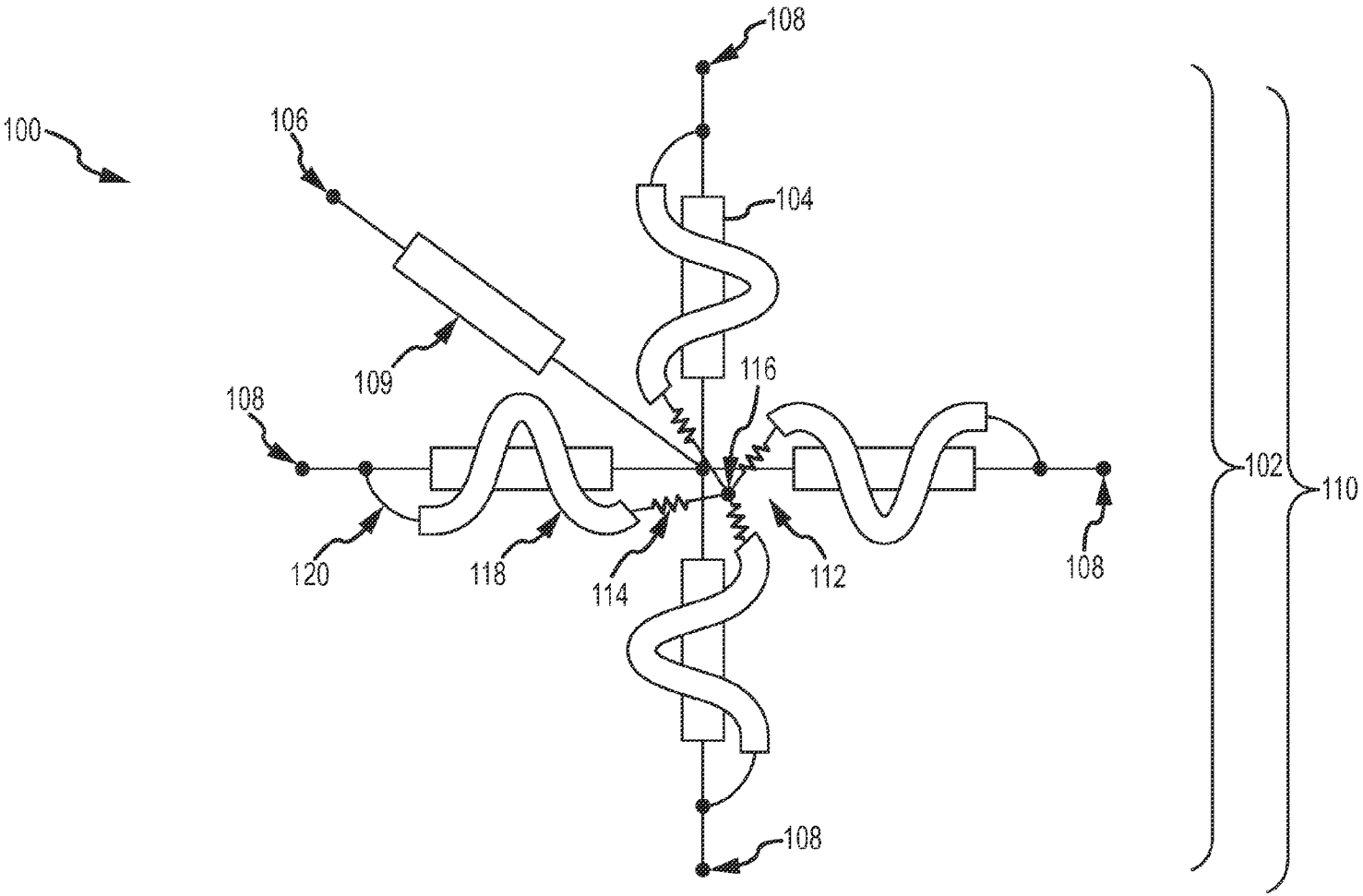
FIG. 6 is a schematic diagram of a multi-layer radial power divider/combiner in accordance with the present invention that realizes the benefits of planar topology without comprising the isolation network.

As shown in a schematic illustration in FIG. 6, a radial power combiner/divider 100 comprises an RF layer 102 including N planar RF transmission lines 104 radiating from a common port 106 to N ports 108 where N is an integer greater than two (N=4 is the depicted schematic). An optional quarter-wave transmission line 109 may be inserted in front of the common port to improve the voltage standing wave ratio (VSWR) bandwidth and reduce the impedance requirements of the RF transmission lines 104. The RF transmission lines 104 are configured to transmit electromagnetic waves centered at a wavelength λc. Each RF transmission line has an electrical length of approximately A*λc/4 where is A an integer. Electrical length is measured as a fraction of the wavelength. A is suitably 1 to keep the length of the transmission lines, hence loss of the splitter at a minimum. The RF transmission lines 104 function as an impedance matching transform so that each port of the splitter provides a good match to the system characteristic impedance Z0.

An isolation layer 110 substantially parallel to the RF layer 102 comprises a star resistor 112 having N resistive arms 114 radiating from a common junction 116, each resistive arm having an electrical length L1, and N planar isolation transmission lines 118 of electrical length L2 coupled in series to respective resistive arms. Each series pair of a resistive arm and an isolation transmission line has a length Lt=L1 plus L2 approximately equal to B*λc/2 where B is an integer. The total length Lt ideally introduces a 0 degree phase angle. In practice, each series pair may introduce no more than an 18 degree phase angle, preferably no more than 5 degrees and most preferably no more than 2.5 degrees. Consequently, the phase angle between any two paths 2*Lt is no more than 36 degrees, preferably no more than 10 degrees and most preferably no more than 5 degrees. B is ideally 1 to maximize the bandwidth of isolation and port impedance matching. The length of L1 can be up to approximately λc/8 and the splitter network will provide good response, but the longer L1 is the less bandwidth will be provided. Note that in Wilkinson's design, the length L1 of the resistor should be restricted to be less than λc/20 in order to maintain a phase angle of no more than 36 degrees between any two paths.

N vertical interconnects 120 between the RF layer 102 and the isolation layer 110 connect the ends of the N isolation transmission lines to the ends of the N RF transmission lines at the N individual ports 108, respectively. The vertical interconnects may be electrically conductive vias or other suitable transmission lines.

Figure 1:
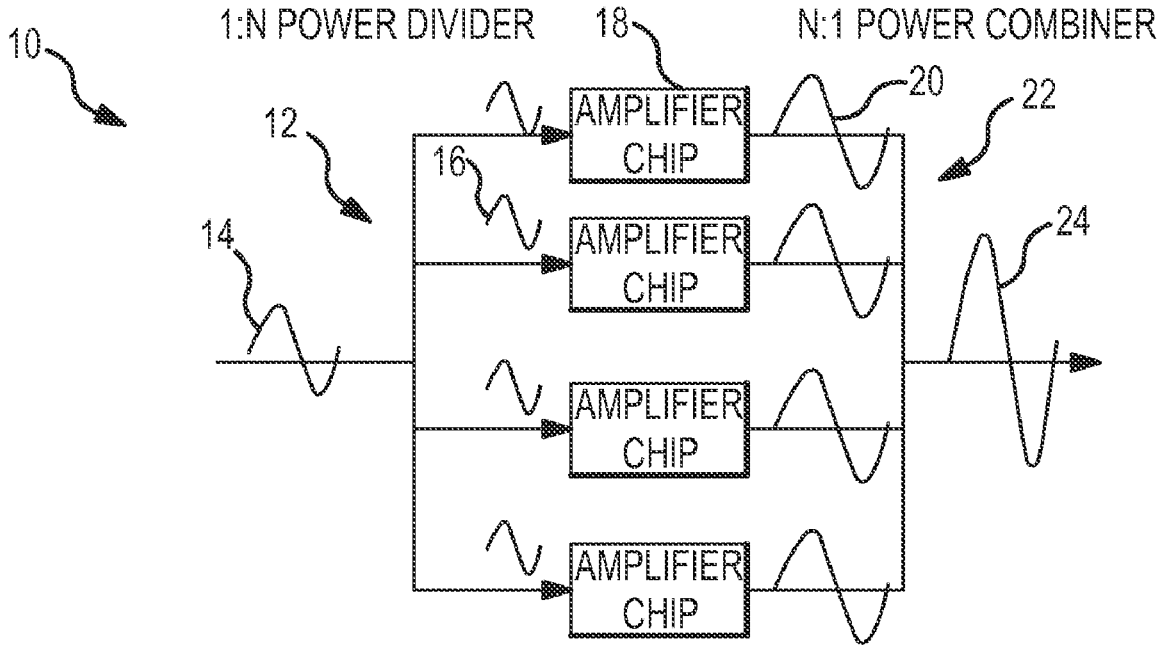
FIG. 1 (PRIOR ART)
FIG. 1, as described above, is a block diagram of a solid-state power amplifier (SSPA)
Figure 2A:
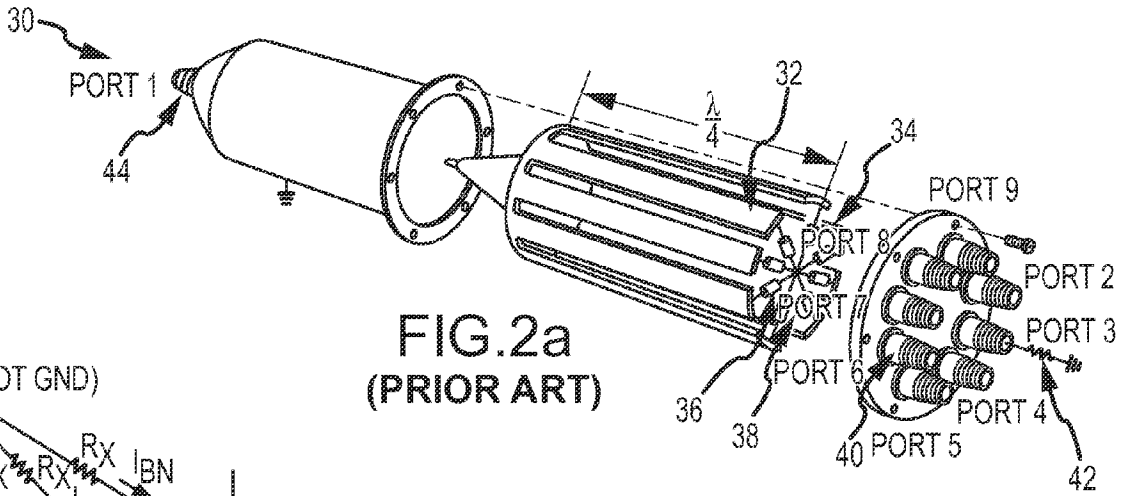
FIG.2a (PRIOR ART)
FIGS. 2*a* and 2*b*, as described above are a diagram of an N-way Wilkinson radial divider/combiner and its schematic.
Figure 2B:
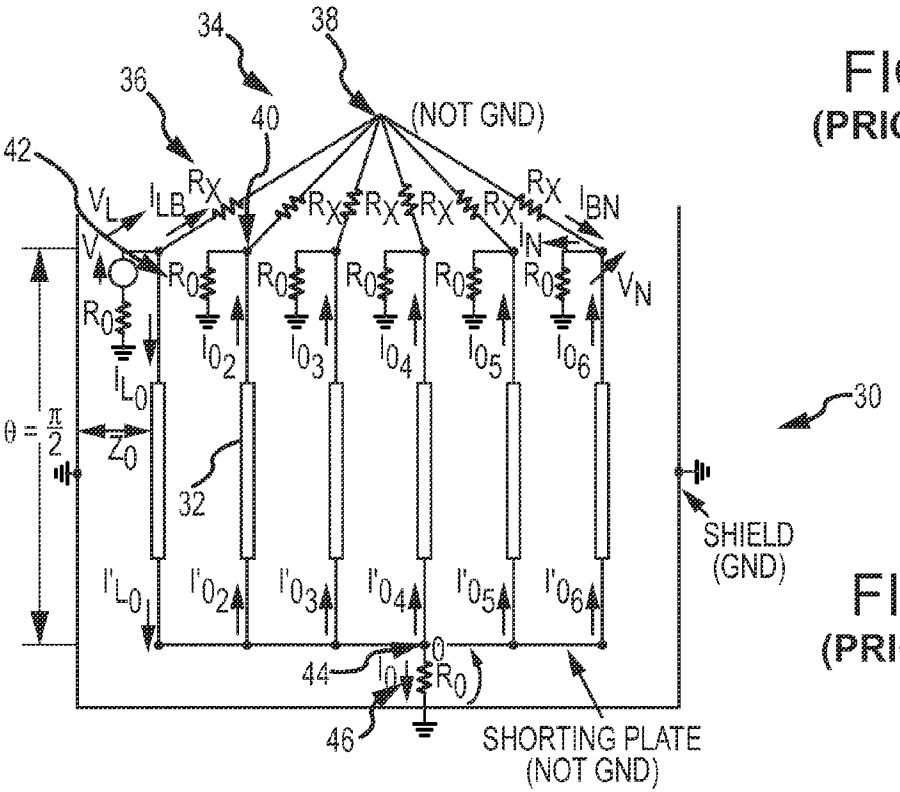
FIG.2b (PRIOR ART)
Figure 3:
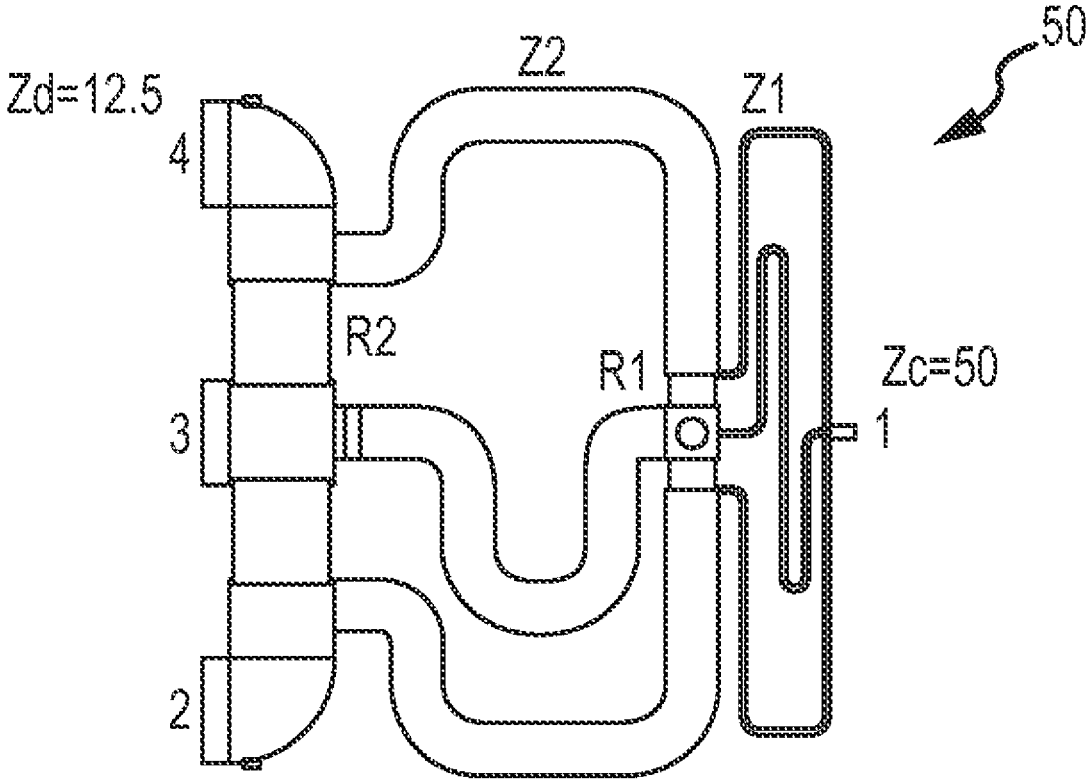
FIG.3 (PRIOR ART)
FIG. 3, as described above is an example of a planar three-way, two-section 1:3 Wilkinson divider that compromises the isolation network to achieve planar topology.
Figure 4:
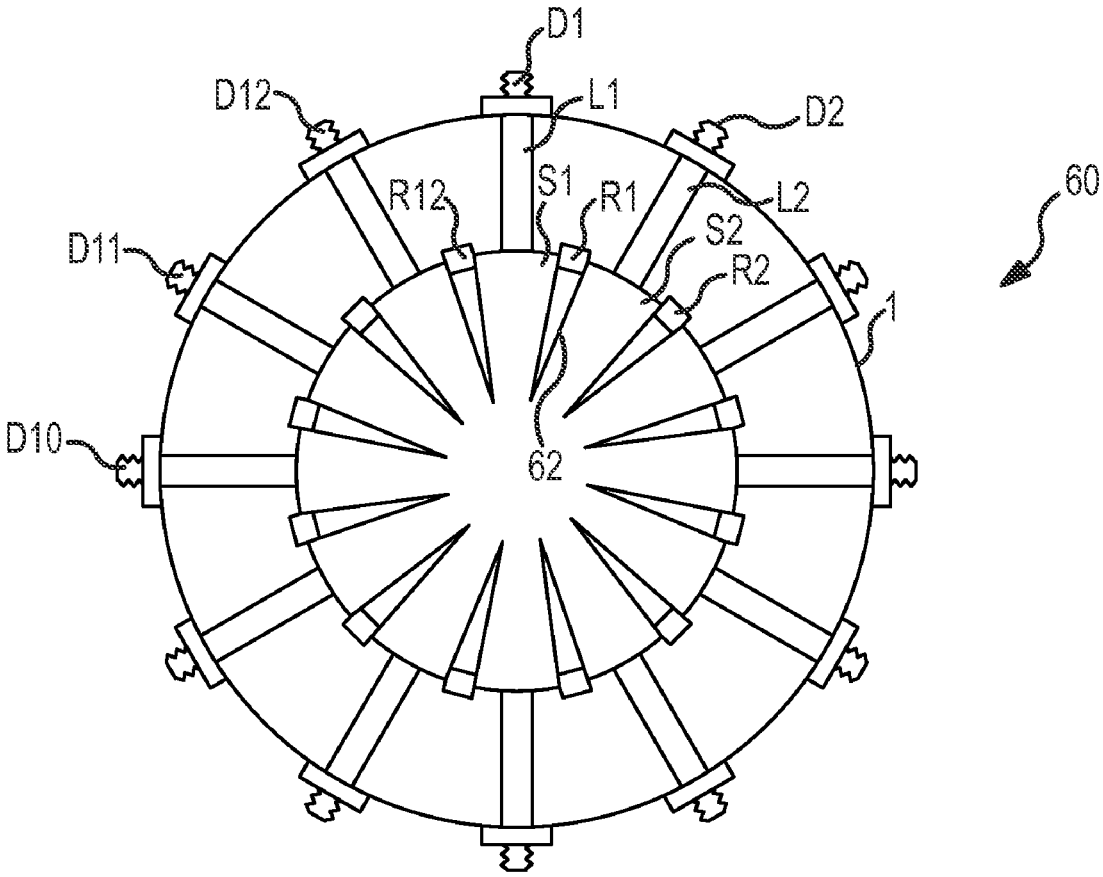
FIG.4 (PRIOR ART)
FIG. 4, as described above, is an example of a planar twelve-way radial combiner that includes isolation resistors between adjacent but compromises isolation between non-adjacent paths.
Figure 5:
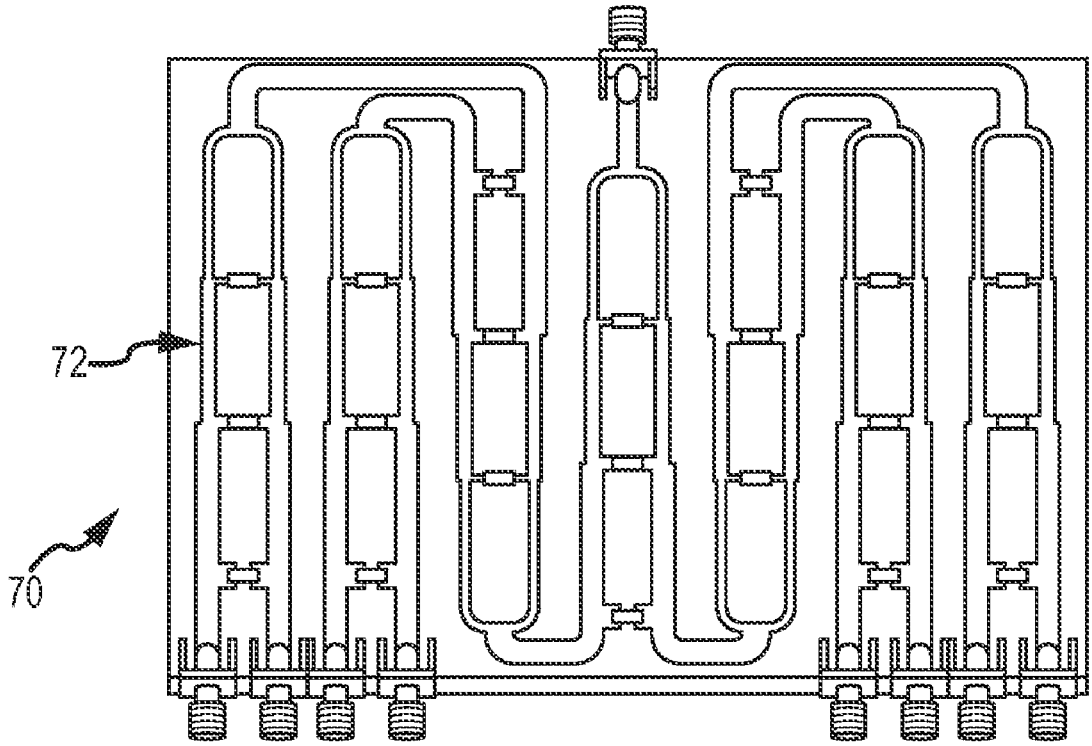
FIG.5 (PRIOR ART)
FIG. 5, as described above, is an example of a planar eight-way splitter using the corporate technique of cascading stages of 2:1 splitters that increases RF losses compared to the Wilkinson N-way splitter.

The isolation transmission lines 118 serve two purposes. First, the isolation transmission lines provide the interconnect length needed to unfold the Wilkinson topology of FIG. 2*a* down into a multi-layer planar topology. Second, the isolation transmission lines can compensate for the finite phase of the resistive arms 114 so that each series pair is ideally a half wavelength. Consequently, any path from one individual port 108 through the common junction 116 of the star resistor to another individual port 108 is approximately a full wavelength λc or multiple thereof. It follows that the phase angle of the isolation network from any port to any other port is approximately zero electrical degrees at center frequency. This approach can ideally achieve perfect isolation and impedance matching at center frequency like the Wilkinson design but with the benefits of planar metallization technology.

In conventional Wilkinson designs, the resistive arms of the star resistor are as short as possible, less than λc/20, to minimize the electrical phase angle. This places a limitation on how much power can be dissipated in the isolation network, hence how much power can be transmitted through the combiner in an SSPA under real (non-ideal) conditions such as after a singular power amplifier failure. The use of isolation transmission lines has the side benefit of allowing larger (electrically longer) resistors (e.g. ≦λc/8) to dissipate more power as necessary. In an embodiment, the resistors have an electrical length >λc/20. In another embodiment, the resistors have an electrical length >λc/10. The capability to work with larger or longer resistors simplifies the manufacturing process of the isolation resistors. In the higher frequency regimes the resistors become very small to maintain a small phase through the resistor. The ability to relax that length constraint makes the resistors easier to produce.

In this multi-layer but planar topology each of the star resistor, RF transmission lines, isolation transmission lines and vertical interconnects may be may be fabricated using low-cost batch manufacturing technologies. The star resistor comprises a chip resistor of metal patterned on an insulating material. The RF transmission lines may be realized in coax, stripline, microstrip or waveguide where the key characteristic (of the combiner) is low electrical loss. A coaxial structure comprises an inner conductor and an outer shield sharing a common axis and separated by an insulating medium such as air or poly tetra-ethylene (PTFE) based materials. Air coax can support the higher impedances required of the quarter-wave RF transmission lines for larger N, while PTFE based materials can provide much higher peak power handling because breakdown voltage is many orders of magnitude higher. A stripline comprises a flat strip of metal between two parallel ground planes separated by an insulating material. A microstrip is similar to a stripline but only comprises a single ground plane. A waveguide is a hollow conductive pipe sized in cross-section to permit electromagnetic propagation at the frequency band of interest, similar to a coax without the inner conductor and typically (but not always) filled with air. In an embodiment, the RF transmission lines are an air coax for low-loss performance and the isolation transmission lines where low loss is not a key characteristic are stripline for reduced cost. The vertical interconnects may be as simple as conductive vias or may be transmission lines. Each of these structures may be fabricated using low-cost planar metallization techniques.

Multi-Layer Air-Coax Power Divider/Combiner

Figure 7A:
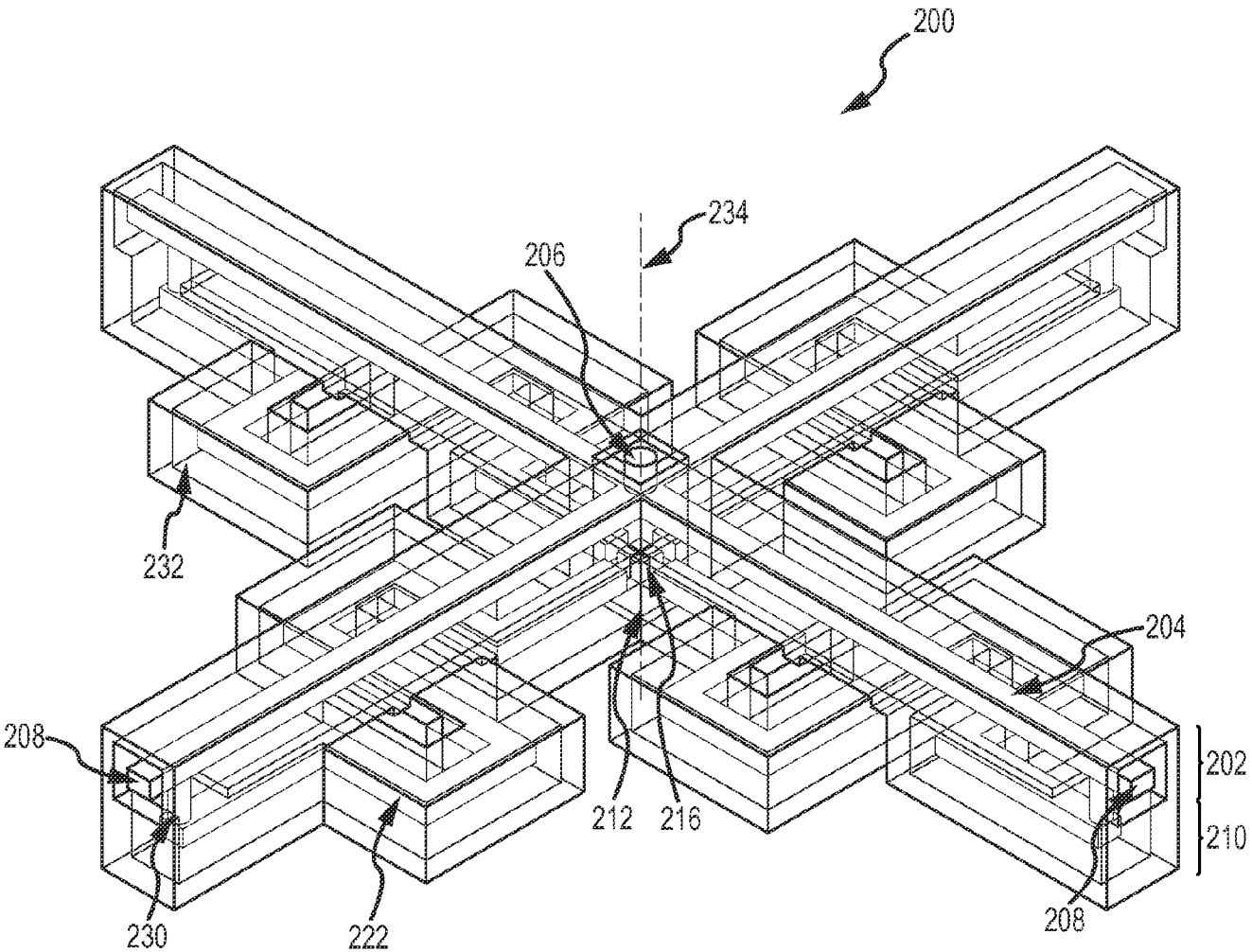
FIGS. 7*a* through 7*c* are a perspective view of an embodiment of a four-way multi-layer radial power divider/combiner using air-dielectric rectangular coax for the RF and isolation transmission lines, a section view of the air coax and a perspective view of a chip resistor for providing the star-resistor.
Figure 7B:
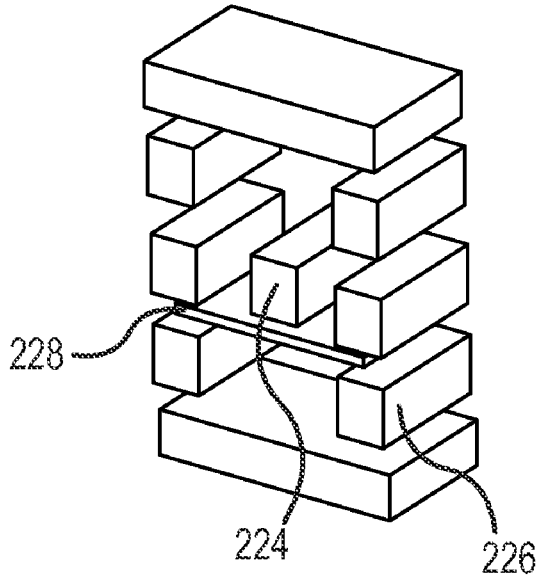
Figure 7C:
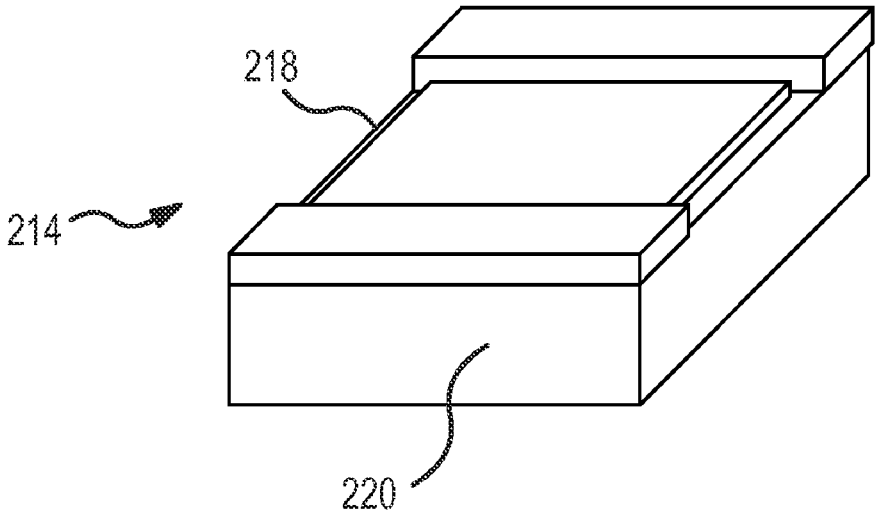

An embodiment of a four-way multi-layer air-coax power divider/combiner 200 for Ka-band operation is illustrated in FIGS. 7*a* through 7*c*. λc is center at 33.25 GHz with a 40% bandwidth that spans 26.5 GHz to 40 GHz with at least −40 dB isolation ideally across the bandwidth.

The four-way air-coax power divider/combiner 200 comprises an RF layer 202 including four RF air-coax lines 204 radiating from a common port 206 to four ports 208. A quarter-wave transmission line (not shown) can be coupled to the common port to improve the voltage standing wave ratio (VSWR) bandwidth and reduce the impedance requirements of the RF air-coax media. The RF air-coax lines 204 are configured to transmit electromagnetic waves centered at a wavelength λc. Each RF air-coax line has a length of approximately λc/4. The system impedance Z0 is suitably 50 ohms. Each RF section has an impedance of 100 ohms. An isolation layer 210 substantially parallel to the RF layer 202 comprises a star resistor 212 having N resistive arms 214 radiating from a common junction 216. Each resistive arm comprises a chip resistor of patterned metal 218 on an insulating layer 220 (e.g. thin or thick film printed resistors) having a length L1, or alternatively all resistors could be realized on a single custom chip. N isolation air-coax lines 222 of length L2 are coupled in series to respective resistive arms. Each air-coax line comprises an inner conductor 224 and an outer shield 226 sharing a common axis and separated by air. The outer shield and inner conductor are suitably formed from the same conductive materials. Nuvotronics, LLC has developed an air micro-coax using its PolyStrata™ Technology in which the inner conductor 224 is supported on straps of a thin dielectric layer 228 placed periodically along the coax line. As shown, using the PolyStrata™ Technology the outer shield 226 is formed from multiple layers of patterned metal. Other technologies may be used to implement suitable coax or air coax structures for the divider/combiner. The isolation resistors and inner conductor of the isolation transmission lines are electrically connected. Each series pair of a resistive arm and an isolation transmission line has a length Lt=L1 plus L2 approximately equal to λc/2. N vertical air-coax lines 230 between the RF layer and the isolation layer connect the ends of the N isolation air-coax lines to the ends of the N RF air-coax lines at the N individual ports 208, respectively. The RF and isolation layers and vertical interconnects are fabricated in a multi-layer batch-manufactured structure 232.

As depicted in this particular embodiment, common port 206 in the RF layer and common junction 216 in the isolation layer are substantially co-axial along axis 234. The RF air-coax lines 204 follow a straight path from the common port to the respective N ports 208. The longer isolation air-coax lines 222 follow a curved path from the ends of the star resistor 212 to the vertical air-coax lines that connect to the RF air-coax lines at the respective N ports 208. The curved path may be a simple curve or a meandering path.

Multi-Layer Air-Coax/Stripline Power Divider/Combiner

Figure 8A:
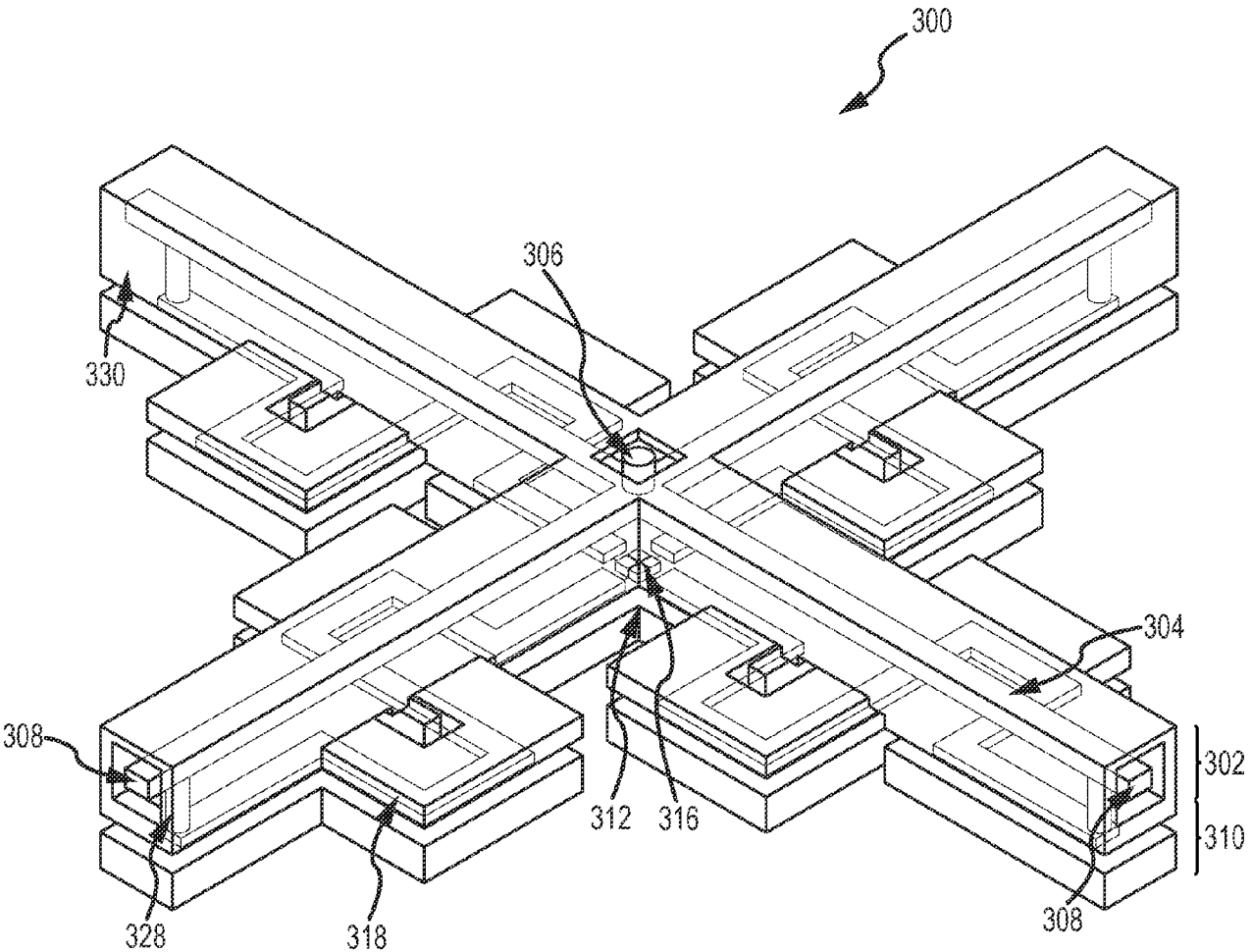
FIGS. 8*a* and 8*b* are a perspective view of an embodiment of a four-way multi-layer radial power divider/combiner using air coax for the RF and stripline for the isolation transmission lines and a section view of the stripline.
Figure 8B:
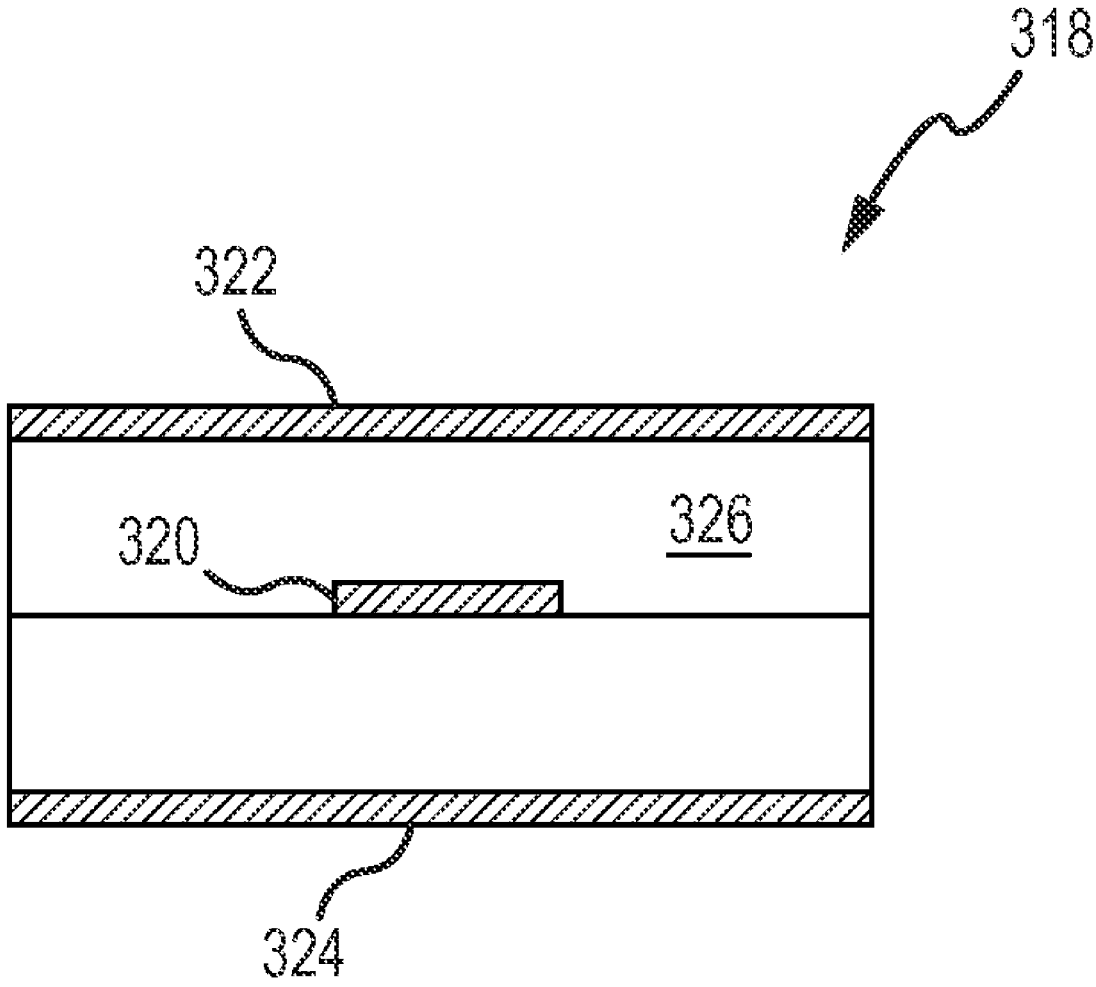

An embodiment of a four-way multi-layer air-coax/stripline power divider/combiner 300 for Ka-band operation is illustrated in FIGS. 8*a* and 8*b*. λc is center at 33.25 GHz with a 40% bandwidth that spans 26.5 GHz to 40 GHz with at least −40 dB isolation ideally across the bandwidth. The air-coax provides the low loss desirable for the RF lines. The stripline is a less expensive alternative for the isolation layer where low loss is not required.

The four-way air-coax power divider/combiner 300 comprises an RF layer 302 including four RF air-coax lines 304 radiating from a common port 306 to 4 ports 308. A quarter-wave transmission line (not shown) may be coupled to the common port to improve the voltage standing wave ratio (VSWR) bandwidth and reduce the impedance requirements of the RF transmission lines. The RF air-coax lines 304 are configured to transmit electromagnetic waves centered at a wavelength λc. Each RF air-coax line has a length of approximately λc/4. The system impedance Z0 is suitably 50 ohms. Each RF section has an impedance of 100 ohms.

An isolation layer 310 substantially parallel to the RF layer 302 comprises a star resistor 312 having N resistive arms radiating from a common junction 316. Each resistive arm comprises a chip resistor similar to that shown in FIG. 7*c* having an electrical length L1. N isolation striplines 318 of length L2 are coupled in series to respective resistive arms. Each stripline comprises a flat strip of metal 320 between two parallel ground planes 322, 324 separated by an insulating material 326 as shown in FIG. 8*b*. The isolation resistor and metal 320 are suitably electrically connected. Each series pair of a resistive arm and an isolation transmission line has a length Lt=L1 plus L2 approximately equal to λc/2. N vertical conductive vias 328 between the RF layer and the isolation layer connect the ends of the N isolation air-coax lines to the ends of the N RF air-coax lines at the N individual ports 308, respectively. The RF and isolation layers and vertical interconnects are fabricated in a multi-layer structure 330.

Predicted Performance for an Ideal Eight-Way Air-Coax Power Divider/Combiner

Figure 9A:
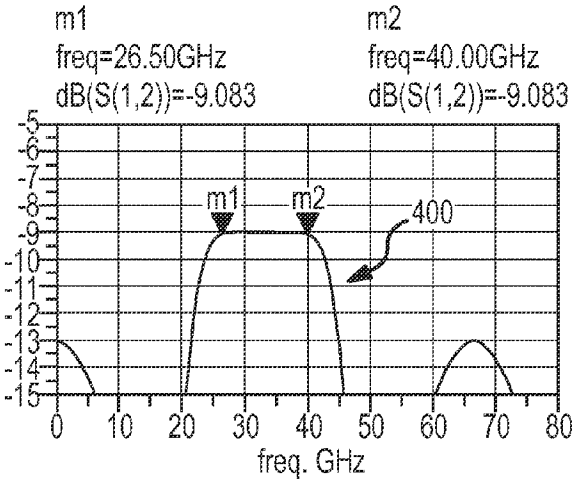
FIGS. 9*a* through 9*c* are plots of the ideal power transfer, isolation and return losses for an eight-way multi-layer radial power divider/combiner for use in the Ka band.
Figure 9B:
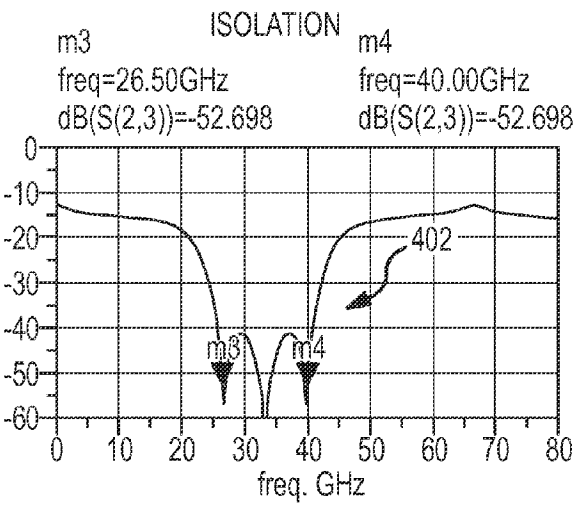
Figure 9C:
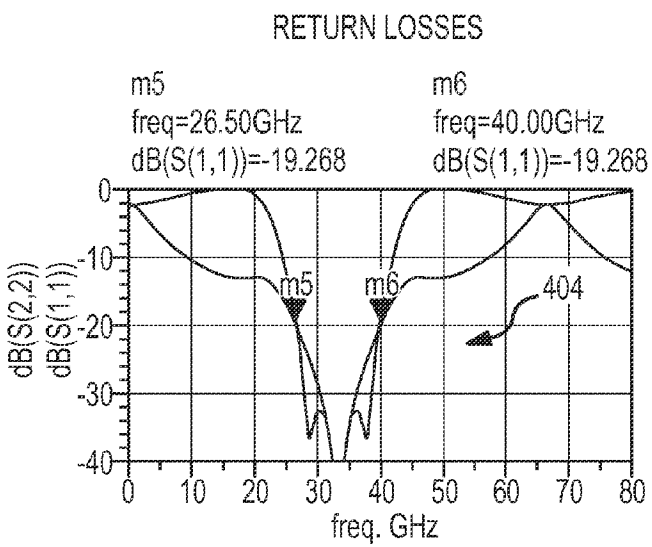

FIGS. 9*a* through 9*c* plot the power transfer 400, isolation 402 and return losses 404 for an ideal 8-way multi-layer air-coax power divider/combiner over the 26.5 to 40 GHz band. A transformer on the common port was included to improve frequency response.

Ideal power transmission in a 1:8 split is 10 log(1/8)=−9.04 dB. As shown in FIG. 9*a*, the ideal power transfer 400 is −9.083 dB at the edges of the band. 0.043 dB is lost to reflection in this ideal simulation (no attenuation characteristics of the transmission line media were accounted for). As shown in FIG. 9*b*, the ideal isolation 402 is less than −40 dB over the band. The actual isolation in a manufactured device is expected to be degraded slightly as those skilled in the art would expect. As shown in FIG. 9*c*, the ideal return losses 404 are less than approximately −20 dB across the band.

Multi-Stage Multi-Layer Topology

Figure 10:
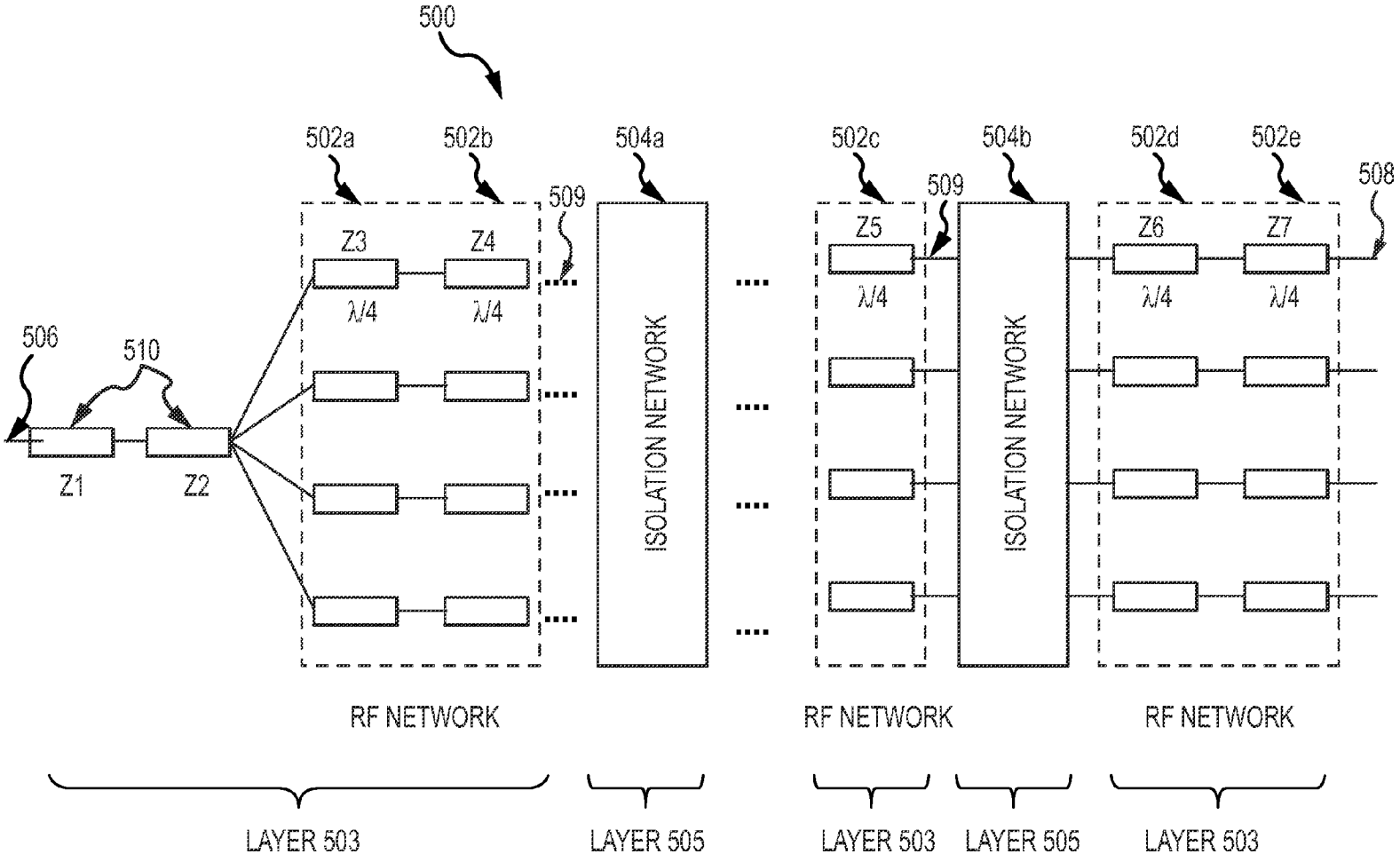
FIG. 10 is a diagram illustrating a multi-stage radial power divider/combiner.

As shown in FIG. 10, the multi-layer radial power combiner/divider 500 may be implemented with a multi-stage topology. Multiple RF quarter-wave transformers 502*a*, 502*b*, 502*c*, 502*d*, 502*e* can be realized in separate networks on separate layers or adjacent transformers can be combined on one layer to create a multi-section RF network on a single layer 503. With the use of multiple transformer sections the required impedance transformation from Z0 to N*Z0 can be made gradually and thus performance is improved. Multiple isolation networks 504*a* and 504*b* each occupy a separate layer 505. The overall structure 500 serves to route signal power between a common port 506 and N ports 508. For an N-way combiner or divider, only one RF transformer layer provides the split, combining N nodes to a single node. The additional RF network layers have N input ports and N output ports, connecting between the N ports of the preceding isolation network and the N ports of the next isolation network (or forming the N outputs of the divider). Vertical interconnects 509 connect ports between layers. One or more single transformers 510 may be coupled to the common port 506, and can be manufactured on the same layer as the unique splitting layer. In general, the greater the number of RF quarter wave transformer sections (or RF network layers) the wider the frequency band of the input impedance match can be The greater the number of isolation networks (layers) the wider the bandwidths of the output impedance match and isolation can be. The number of RF layers and isolations layers may or may not be equal.

In an embodiment of the simplest case, the divider/combiner includes only a single RF section comprised of single quarter-wave transformers 502*a* and a single isolation network 504*a*. In another embodiment, the divider/combiner includes a single RF section comprised of a cascade of two quarter-wave transformers 502*a* and 502*b* in front of a single isolation section 504*a*. In this case, the total RF network arms are half-wavelength which may have a manufacturing benefit because the isolation network arms are the same length and need not be meandered. In another embodiment, one or more single transformers 510 are coupled to the common port.

In another embodiment, a two-stage divider/combiner comprises a first RF network with quarter wave transformers 502*a*, a first isolation network 504*a*, a second RF network with quarter wave transformers 502*c* and a second isolation section 504*b*. This configuration could provide more than 40% bandwidth. Vertical interconnects 509 connect ports between the different networks and layers. More specifically in an N-way two-stage device, the second RF layer 502*b* may comprise N planar second RF transmission lines connecting N first ports to N second ports respectively. The lines are configured to transmit electromagnetic waves centered at wavelength λc. Each RF transmission line has an electrical length of approximately C*λc/4 where C is an integer. N vertical interconnects between the isolation layer 504*a* and the second RF layer 502*b* connect the ends of the N ports of the first isolation layer to the N first ports in the second RF layer, respectively. A second isolation layer 504*b* substantially parallel to the second RF layer may comprise a second star resistor having N resistive arms radiating from a common junction, each resistive arm having an electrical length L3, and N planar second isolation transmission lines of electrical length L4 coupled in series to respective resistive arms each series pair of a resistive arm and an isolation transmission line having a length L3 plus L4 approximately equal D*λc/2 where D is an integer. N vertical interconnects between the second RF layer and the second isolation layer connect the ends of the N second isolation transmission lines to the ends of the N second RF transmission lines at the N second ports, respectively.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A radial power combiner/divider, comprising:

an RF layer comprising N planar RF transmission lines radiating from a common port to N ports where N is an integer greater than two, said lines configured to transmit electromagnetic waves centered at a wavelength λc, each said RF transmission line having a electrical length of approximately A*λc/4 where is A an integer, an isolation layer substantially parallel to the RF layer, said isolation layer comprising:

a star resistor having N resistive arms radiating from a common junction, each of the resistive arms having an electrical length L1; and N planar isolation transmission lines of electrical length L2 coupled in series to the respective resistive arms, each said series pair of a one of the resistive arms and an one of the isolation transmission lines having a length L1 plus L2 approximately equal B*λc/2 where B is an integer; and N vertical interconnects between said RF layer and said isolation layer, each said vertical interconnect connecting an end of one of the N isolation transmission lines to an end of one of the N RF transmission lines at the N ports, respectively.

2. The radial power combiner/divider of claim 1, wherein λc is between approximately 0.1 cm and 30 cm.

3. The radial power combiner/divider of claim 1, wherein the RF transmission lines and the isolation transmission lines are a coaxial, a stripline, a microstrip or a waveguide structure.

4. The radial power combiner/divider of claim 1, wherein the RF transmission lines comprise an air coaxial structure comprising an inner conductor and an outer shield separated by air.

5. The radial power combiner/divider of claim 4, wherein the isolation transmission lines comprise a flat strip of metal between two parallel ground planes separated by an insulating material.

6. The radial power combiner/divider of claim 1, wherein A equals 1 and B equals 1.

7. The radial power combiner/divider of claim 1, wherein the star resistor comprises a chip resistor of metals or fired resistive pastes patterned on an insulating material.

8. The radial power combiner/divider of claim 1, wherein the length L1 of each of the arms of the star resistor is no greater than λc/8.

9. The radial power combiner/divider of claim 8, wherein the length L1 of each of the arms of the star resistor is greater than λc/20.

10. The radial power combiner/divider of claim 1, wherein the electrical length L1 plus L2 of the series pair of the resistive arm and the isolation transmission line is within plus or minus 18 degrees of λc.

11. The radial power combiner/divider of claim 1, wherein any path from a first one of the N ports through the common junction of the star resistor to a second of the N ports is approximately λc or multiple thereof whereby the phase angle through an isolation network between the first port and the second port is approximately zero degrees.

12. The radial power combiner/divider of claim 1, wherein each said RF transmission line having an impedance of approximately square-root(N) multiplied by Z0.

13. The radial power combiner/divider of claim 1, further comprising N solid-state power amplifiers coupled to the respective N ports.

14. The radial power combiner/divider of claim 1, wherein the vertical interconnects comprise a conductive via.

15. The radial power combiner/divider of claim 1, wherein the vertical interconnects comprise a transmission line.

16. The radial power combiner/divider of claim 1, wherein the common port and common junction are substantially coaxial, each said RF transmission line following a straight path from the common port to one of the respective N ports, each said isolation transmission line following a curved path from an end of one of the arms of the star resistor to one of the respective N ports.

17. The radial power combiner/divider of claim 1, further comprising:

a second RF layer comprising N planar second RF transmission lines connecting N first ports to N second ports respectively, said lines configured to transmit electromagnetic waves centered at wavelength λc, each said RF transmission line having a electrical length of approximately C*λc/4 where C is an integer, a second N vertical interconnects between said isolation layer and said second RF layer, each said second vertical interconnect connecting one of the N ports to one of the N first ports in the second RF layer, respectively;

a second isolation layer substantially parallel to the second RF layer, said isolation layer comprising:

a second star resistor having N resistive arms radiating from a second common junction, each of the resistive arms having an electrical length L3; and N planar second isolation transmission lines of electrical length L4 coupled in series to the respective resistive arms, each said series pair of one of the resistive arms and one of the isolation transmission lines having a length L3 plus L4 approximately equal D*λc/2 where D is an integer; and a third N vertical interconnects between said second RF layer and said second isolation layer, each said third vertical interconnect connecting an end of one of the N second isolation transmission lines to an end of one of the N second RF transmission lines at the N second ports, respectively.

18. A radial power combiner/divider, comprising:

an RF layer comprising N RF air-coaxial planar transmission lines radiating from a common port to N ports where N is an integer greater than two, said lines configured to transmit electromagnetic waves centered at a wavelength λc between 0.1 cm and 30 cm, each said RF transmission line having a length of approximately λc/4, an isolation layer substantially parallel to the RF layer, said isolation layer comprising:

a star chip resistor having N resistive arms radiating from a common junction, each of the resistive arms having a length L1 no greater than λc/8; and N isolation stripline transmission lines of length L2 coupled in series to the respective resistive arms, each said series pair of a resistive arm and an isolation transmission line having a length L1 plus L2 of λc/2 within a plus or minus 18 degree tolerance; and N vertical interconnects between said RF layer and said isolation layer each said vertical interconnect connecting an end of one of the N isolation transmission lines to an end of one of the N RF transmission lines at the N ports, respectively.

19. A radial power combiner/divider, comprising:

a first RF layer comprising N planar RF transmission lines radiating from a common port to N first ports where N is an integer greater than two, said lines configured to transmit electromagnetic waves centered at a wavelength λc, a first isolation layer substantially parallel to the first RF layer, said first isolation layer comprising:

a star resistor having N resistive arms radiating from a common junction; and

N planar isolation transmission lines coupled in series to the respective resistive arms; and N vertical interconnects between said RF layer and said isolation layer, each said vertical interconnect connecting an end of one of the N isolation transmission lines to an end of one of the N RF transmission lines at the N first ports, respectively, said isolation layer configured so that any two of the first ports are separated by a path through the common junction of the star resistor having a length of approximately λc or an integer multiple thereof at an approximately zero phase angle.

20. The radial power combiner/divider of claim 19, wherein the length of each one of the series connected pairs of one of the resistive arms and one of the isolation transmission lines is approximately λc/2 or an integer multiple thereof within a plus or minus 18 degree tolerance and the length of each of the arms of the star resistor is no greater than λc/8.

21. The radial power combiner/divider of claim 19, further comprising:

a second RF layer comprising N planar second RF transmission lines connecting N second ports to N third ports respectively, said lines configured to transmit electromagnetic waves centered at wavelength λc, a second N vertical interconnects between said first isolation layer and said second RF layer, each said second vertical interconnect connecting one of the N first ports to one of the N second ports in the second RF layer, respectively;

a second isolation layer substantially parallel to the second RF layer, said isolation layer comprising:

a second star resistor having N resistive arms radiating from a second common junction; and N planar second isolation transmission lines coupled in series to one of the respective resistive arms; and a third N vertical interconnects between said second RF layer and said second isolation layer, each said third vertical interconnect connecting an end of one of the N second isolation transmission lines to an end of one of the N second RF transmission lines at the N third ports, respectively.

* * * * *